US007202206B2

(12) United States Patent
Depoot et al.

(10) Patent No.: US 7,202,206 B2
(45) **Date of Patent: *Apr. 10, 2007**

(54) DETERGENT COMPOSITION

(75) Inventors: Karel Jozef Maria Depoot, Anzegem (BE); Francesco de Buzzaccarini, Breendonk (BE); Jan Julien Marie-Louise Billiauw, Genbrugge (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/298,115

(22) Filed: Dec. 9, 2005

(65) Prior Publication Data

US 2006/0089294 A1 Apr. 27, 2006

Related U.S. Application Data

(63) Continuation of application No. 10/439,548, filed on May 16, 2003, now Pat. No. 7,033,987.

(30) Foreign Application Priority Data

May 17, 2002 (GB) ..... 0211339.7

(51) Int. Cl.
*C11D 7/02* (2006.01)

(52) U.S. Cl. ..... 510/507; 510/527

(58) Field of Classification Search ..... None
See application file for complete search history.

(56) References Cited

U.S. PATENT DOCUMENTS

| | | | | |
|---|---|---|---|---|
| 6,727,215 | B2 * | 4/2004 | Roberts et al. | 510/296 |
| 7,033,987 | B2 * | 4/2006 | Depoot et al. | 510/437 |
| 2004/0045093 | A1 * | 3/2004 | Oakes et al. | 8/115.51 |

FOREIGN PATENT DOCUMENTS

| | | | |
|---|---|---|---|
| WO | WO 97/31998 | * | 9/1997 |

* cited by examiner

*Primary Examiner*—John R. Hardee
(74) *Attorney, Agent, or Firm*—Armina E. Matthews; Kim William Zerby

(57) ABSTRACT

The present invention relates to a liquid softening through the wash laundry detergent composition comprising: (a) at least 0.5% by weight of the composition, of a fabric softening silicone; and (b) a fatty acid; and (c) a surfactant system, the surfactant system comprising: (i) at least 75% by weight of the surfactant system, of a non-alkoxylated anionic surfactant; and (ii) less than 25% by weight of the surfactant system, of an alkoxylated surfactant; and (d) one or more laundry detergent adjunct ingredients.

22 Claims, No Drawings

DETERGENT COMPOSITION

This is a continuation of U.S. application 10/439,548, filed May 16, 2003, now U.S. Pat. No. 7,033,987.

TECHNICAL FIELD OF THE INVENTION

The present invention relates to liquid laundry detergent compositions, especially liquid softening through the wash laundry detergent compositions.

BACKGROUND TO THE INVENTION

Liquid softening through the wash laundry detergent compositions are capable of softening and cleaning fabric during a washing process. It is known that silicones can be used as fabric-softening actives and can be incorporated in liquid laundry detergent compositions to provide a fabric-softening benefit during the washing process. However, simply incorporating a silicone in a liquid laundry detergent composition does not always confer a good fabric-softening performance to the composition.

In order to achieve a good fabric-softening performance during the washing process, detergent manufacturers have considered using silicone emulsions. For example, WO97/31997 describes silicone emulsions that can be used in liquid softening through the wash laundry detergent compositions. However, the fabric-softening performance of these silicone emulsions is still not good enough and needs to be improved.

One method of improving the fabric-softening performance of these silicone emulsions is to use them in combination with a cationic fabric-softening compound. For example, WO97/31998 describes combinations of silicone emulsions and cationic fabric-softening compounds that can be used in liquid softening through the wash laundry detergent compositions. However, the combination of a silicone emulsion and a cationic fabric-softening compound reduce the cleaning and whiteness-maintenance performance of liquid softening through the wash laundry detergent compositions.

In view of the negative effect that this combination has on the cleaning and whiteness-maintenance performance of the composition, detergent manufacturers have not been able to successfully formulate a liquid softening through the wash laundry detergent composition that has both a good fabric-softening performance and a good cleaning and whiteness-maintenance performance. When formulating a liquid softening through the wash laundry detergent composition, detergent manufacturers have to carefully balance the fabric-softening performance of the composition against the cleaning and whiteness-maintenance performance of the composition. To date, all known liquid softening through the wash laundry detergent compositions that comprise a fabric-softening silicone and that have good fabric-softening performance, do not have an adequate cleaning and whiteness-maintenance performance.

SUMMARY OF THE INVENTION

The inventors have developed a liquid softening through the wash laundry detergent composition that comprises a silicone and that has both a good fabric-softening performance and a good cleaning and whiteness-maintenance performance. The present invention provides a liquid softening through the wash laundry detergent composition comprising: (a) at least 0.5% by weight of the composition, of a fabric-softening silicone; and (b) a fatty acid; and (c) a surfactant system, the surfactant system comprises: (i) at least 75% by weight of the surfactant system, of a non-alkoxylated anionic surfactant; and (ii) less than 25% by weight of the surfactant system, of an alkoxylated surfactant; and (d) one or more laundry detergent adjunct ingredients. In a preferred embodiment of the present invention, the ratio of the combined weight of the non-alkoxylated anionic surfactant and the fatty acid to the weight of the alkoxylated surfactant is greater than 3:1, preferably 5:1 or greater.

DETAILED DESCRIPTION OF THE INVENTION

Fabric-Softening Silicone

The composition comprises (by weight of the composition) at least 0.5%, preferably more than 0.8%, or from 1% to 5%, or even from 1% to 3% of a fabric-softening silicone. The fabric-softening silicone typically has the general formula:

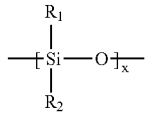

wherein, each $R_1$ and $R_2$ in each repeating unit, —(Si($R_1$)($R_2$)O)—, are independently selected from $C_1$–$C_{10}$ alkyl or alkenyl radicals, phenyl, substituted alkyl, substituted phenyl, or units of —[—$R_1R_2$Si—O—]—; x is a number from 50 to 300,000, preferably from 100 to 100,000, more preferably from 200 to 50,000; wherein, the substituted alkyl or substituted phenyl are typically substituted with halogen, amino, hydroxyl groups, quaternary ammonium groups, polyalkoxy groups, carboxyl groups, or nitro groups; and wherein the polymer is terminated by a hydroxyl group, hydrogen or —$SiR_3$, wherein, $R_3$ is hydroxyl, hydrogen, methyl or a functional group.

Preferably, the fabric-softening silicone is a polydimethyl siloxane. The fabric-softening silicone typically has an average molecular weight, as measured by viscosity, of from 5,000 cst to 5,000,000 cst, or from 7,500 cst to 1,000,000 cst or even from 10,000 cst to 600,000 cst.

The fabric-softening silicone may be a cationic silicone polymer, such as those described in WO02/18528. Preferably the fabric-softening silicone is a mixture of a non-charged silicone polymer with a cationic silicone polymer.

Suitable fabric-softening silicones include: amino-silicones, such as those described in U.S. Pat. No. 4,891,166, EP150872, WO92/01773, WO98/39401, U.S. Pat. No. 5,593,611 and U.S. Pat. No. 4,800,026; quaternary-silicones, such as those described in U.S. Pat. No. 4,448,810, EP459821 and EP530974; high-viscosity silicones, such as those described in WO00/71806 and WO00/71807; modified polydimethyl siloxane; functionalized polydimethyl siloxane such as those described in U.S. Pat. No. 5,668,102; U.S. Pat. No. 6,136,215 and EP1081272, for example polydimethyl siloxanes comprising a pendant amino functionality as described in EP413416; cationic amino-silicones; silicone amino-esters; biodegradable organo-silicones such as those described in WO01/23394; polyquaternary polysiloxane polymers; cationic silicones comprising repeating $N^+$ units, such as those described in U.S. Pat. No. 4,891,166;

amino-silicones comprising pendant EO/PO and epoxy glucamine side chains, such as those described in EP879840; coated amino-silicones, such as those described in WO99/38911; block copolymers of polydimethyl siloxane and EO/PO units, as described in WO97/32917; and mixtures thereof.

The fabric-softening silicone may preferably be a mixture of two or more different types of silicone. The fabric-softening silicone may be a mixture of a high-viscosity silicone and a low viscosity silicone. The fabric-softening silicone may even be a mixture of a functionalised silicone and a non-functionalised silicone.

The fabric-softening silicone, when present in the composition, is preferably in the form of an emulsion, typically having a volume average primary particle size of from 1 micrometer to 5,000 micrometers, preferably from 1 micrometer to 50 micrometers. Due to the surfactant system used, the fabric-softening silicone in the form of an emulsion having a volume average primary particle size of from 1 micrometer to less than 5 micrometers is capable of being deposited onto fabric during the laundering process. This is extremely beneficial since smaller particle sized silicone emulsions are more easily processed and are more stable during storage. The volume average primary particle size can be measured using a Coulter Multisizer™, by the method described in more detail below for measuring the particle size of the composition (i.e. for the embodiment of the present invention wherein the composition is in the form of a dispersion).

Commercially available silicone oils that are suitable for use are DC200™ (12,500 cst to 600,000 cst), supplied by Dow Corning. Alternatively, preformed silicone emulsions are also suitable for use. These emulsions may comprise water and/or other solvents in an effective amount to aid in the emulsion.

Fatty Acid

The composition comprises a fatty acid. The composition typically comprises (by weight of the composition) from 1% to 35%, or even from 5% to 20% of a fatty acid. It has been found that the addition of a fatty acid in the composition provides further improved fabric-softening and cleaning performance. Preferred fatty acids are $C_{12}$–$C_{18}$ saturated and/or unsaturated fatty acids, highly preferred is a mixture of such fatty acids. It may be preferred that a mixture of saturated and unsaturated fatty acids is used. For example, preferred is a mixture of rape seed-derived fatty acid and $C_{16}$–$C_{18}$ topped whole cut fatty acids, or a mixture of rape seed-derived fatty acid and a tallow alcohol derived fatty acid.

Preferred fatty acids are selected from the group consisting of lauric acid, tridecylic acid, myristic acid, pentadecylic acid, palmitic acid, margaric acid, stearic acid, arachidic acid, phytanic acid, behenic acid and combinations thereof. The fatty acid may be selected from the group consisting of palmitoleic acid, oleic acid, elaidic acid, vaccenic acid, linoleic acid, cis-eleostearic acid, trans-eleostearic acid, linolenic acid, arachidonic acid, and combinations thereof.

Preferred fatty acids are $C_{12}$–$C_{22}$ fatty acids comprising a saturated alkyl group. Other preferred fatty acids are $C_{12}$–$C_{22}$ fatty acids comprising an unsaturated alkyl group, typically having an iodine value of from 15 to 25, preferably from 18 to 22. Preferred fatty acids have a cis:trans isomer ratio of from 1:1 to 200:1, preferably from 10:1 to 200:1.

Preferred sources of fatty acid are selected from the group consisting of coconut, soybean, tallow, palm, palm kernel, rapeseed, lard, sunflower, corn, safflower, canola, olive, peanut, and combinations thereof.

Surfactant System

The composition comprises a surfactant system. The composition typically comprises (by weight of the composition) from 10% to 50% of a surfactant system. The surfactant system comprises (by weight of the surfactant system) at least 75% non-alkoxylated anionic surfactant and less than 25% alkoxylated surfactant. The surfactant may comprise additional surfactants.

The surfactant system enables the fabric-softening silicone to be adequately deposited onto fabric without the need for any additional deposition aid. This enhanced fabric-softening silicone deposition provides a good fabric-softening performance and negates the need for additional fabric-softening quaternary ammonium compounds to be included in the composition. In addition, the surfactant system enables the deposition onto fabric of very small silicone particles. Thus, the fabric-softening silicone can be in the form of an emulsion having a small silicone particle size, i.e. of less than 5 micrometers, preferably from 1 micrometer to less than 5 micrometers, or even less than 4 micrometers. Previously, adequate silicone deposition could only be achieved by using silicone emulsions having a larger silicone primary particle size.

Preferably the ratio of the combined weight of the non-alkoxylated anionic surfactant and the fatty acid to the weight of the alkoxylated surfactant is greater than 3:1, preferably 5:1 or greater and more preferably from 10:1 to 20:1. It may also be preferred if the weight ratio of non-alkoxylated anionic surfactant to alkoxylated surfactant is from 4:1 to 30:1, or even from 7:1 to 15:1, most preferably from 8:1 to 12:1. Compositions having these ratios have improved fabric-softening and cleaning performance.

Non-Alkoxylated Anionic Surfactant

The surfactant system comprises (by weight of the surfactant system) at least 75%, or even at least 80%, or even at least 90% of a non-alkoxylated anionic surfactant. It may even be preferred for the surfactant system to comprise essentially only of non-alkoxylated anionic surfactant, and that typically no other type of surfactant is deliberately added to the surfactant system.

The non-alkoxylated anionic surfactant is typically selected from the group consisting of: substituted or unsubstituted, branched or unbranched alkyl sulphate surfactant; substituted or unsubstituted, branched or unbranched alkyl sulphonate surfactant; substituted or unsubstituted, branched or unbranched alkylbenzene sulphate surfactant; substituted or unsubstituted, branched or unbranched alkylbenzene sulphonate surfactant; and mixtures thereof. The non-alkoxylated anionic surfactant is preferably an alkyl sulphate surfactant and/or an alkylbenzene sulphonate surfactant. Preferably, the alkyl sulphate surfactant and/or alkylbenzene sulphonate surfactant is present at a level of at least 8% by weight of the composition. More preferably these anionic surfactants are present at a level of from 10% to 40%, or from 15% to 40%, or even from 18% to 30% by weight of the composition. It may be preferred that only one type of non-alkoxylated anionic surfactant is present in the surfactant system, for example it may be preferred that the only non-alkoxylated anionic surfactant present in the surfactant system is a non-alkoxylated alkyl sulphate surfactant. Alternatively, it may be preferred that the only non-alkoxylated anionic surfactant present in the surfactant system is a non-alkoxylated alkylbenzene sulphonate surfactant. It may be preferred that the non-alkoxylated anionic surfactant is present in the form of a salt, preferably a sodium salt.

Suitable non-alkoxylated anionic surfactants are the primary and/or secondary alkyl sulphate surfactants, typically comprising a linear or branched alkyl or alkenyl moiety having from 9 to 22 carbon atoms, preferably comprising a $C_{12}$–$C_{18}$ alkyl moiety. Suitable for use are beta-branched alkyl sulphate surfactants, typically having a weight average (of the surfactant) branching degree of at least 50%, or at least 60%, or even at least 80%, and possibly even at least 95%. It has been found that these branched alkyl sulphate surfactants provide an improved viscosity profile, especially when clay is present in the composition.

The non-alkoxylated anionic surfactant may be a highly branched alkyl sulphate surfactant. One suitable highly branched alkyl sulphate surfactant is known under the tradename as Isalchem, and is supplied by Condea. Mid-chain branched alkyl sulphate surfactants or sulphonate surfactants are also suitable non-alkoxylated anionic surfactants for use herein. These include the mid-chain branched alkyl sulphate surfactants. Typically, these mid-chain branched alkyl sulphate surfactants have a linear primary alkyl sulphate chain backbone (i.e. the longest linear carbon chain which includes the sulphated carbon atom), which preferably comprises from 12 to 19 carbon atoms and their branched primary alkyl moieties preferably comprise a total of at least 14, and preferably no more than 20, carbon atoms.

Other non-alkoxylated anionic surfactants suitable for use herein are non-alkoxylated anionic sulphonate surfactants, including the salts of $C_5$–$C_{20}$, preferably a $C_{10}$–$C_{16}$, or a $C_{11}$–$C_{13}$, substituted or unsubstituted, branched or unbranched alkylbenzene sulphonate surfactants. Suitable non-alkoxylated anionic sulphonate surfactants also include substituted or unsubstituted, branched or unbranched alkyl ester sulphonate surfactants, substituted or unsubstituted, branched or unbranched $C_6$–$C_{22}$ primary and/or secondary alkane sulphonate surfactants, and any mixture thereof. Suitable non-alkoxylated anionic surfactants are the substituted or unsubstituted, branched or unbranched $C_{11}$–$C_{13}$ alkylbenzene sulphonate surfactants.

Alkoxylated Surfactant

The alkoxylated surfactant is typically any alkoxylated non-ionic surfactant, alkoxylated anionic surfactant, alkoxylated cationic surfactant, and can also be any alkoxylated zwitterionic surfactant and/or alkoxylated amphoteric surfactant. Typically, the alkoxylated surfactant is selected from the group consisting of ethoxylated alcohol non-ionic surfactants, ethoxylated alkyl sulphate anionic surfactants, ethoxylated alkyl sulphonate anionic surfactants, and mixtures thereof. Preferably, the surfactant system comprises (by weight of the surfactant system) less than 15% alkoxylated surfactant. It may also be preferred that the surfactant system comprises no alkoxylated surfactant, i.e. no alkoxylated surfactant is deliberately added to the surfactant system.

Typically, the alkoxylated surfactant is an alkoxylated non-ionic surfactant, typically an alkoxylated alcohol non-ionic surfactant. The alkoxylated non-ionic surfactant can be an ethoxylated alcohol non-ionic surfactant, typically an ethoxylated $C_{10\text{-}20}$ alcohol having an average degree of ethoxylation of from 1 to 12, even more typically an ethoxylated $C_{12\text{-}15}$ alcohol having an average degree of ethoxylation of from 5 to 9. Typically, the alkoxylated alcohol non-ionic surfactant is an alkoxylated primary alcohol non-ionic surfactant. The alkoxylated surfactant can also be an alkoxylated alkyl phenol surfactant, preferably an ethoxylated alkyl phenol surfactant.

The alkoxylated surfactant can be an alkoxylated anionic surfactant. Typical alkoxylated anionic surfactants that are suitable for use herein are the $C_{10}$–$C_{18}$ alkyl alkoxy sulphate surfactants, especially those having an average degree of alkoxylated of from 1 to 10. Preferred alkyl alkoxy sulphate surfactants are $C_{10}$–$C_{18}$ alkyl ethoxy sulphate surfactants having an average degree of ethoxylation of from 6 to 9. Other typical alkoxylated anionic surfactants are the $C_{10}$–$C_{18}$ alkyl alkoxy carboxylate surfactants, especially preferred are the $C_{10}$–$C_{18}$ alkyl ethoxy carboxylate surfactants having an average degree of ethoxylation of from 1 to 5. Particularly preferred alkoxylated anionic surfactants are the alkyl polyethoxylate sulphate surfactants having the general formula:

$$RO(C_2H_4O)_xSO_3^-M^+$$

wherein, R is a saturated or unsaturated, branched or unbranched alkyl moiety having from 10 to 22 carbon atoms, M is a cation which makes the compound water-soluble, especially an alkali metal, ammonium or substituted ammonium cation, and x is a number from 1 to 15.

Laundry Detergent Adjunct Ingredients

The composition comprises one or more laundry detergent adjunct ingredients. Typically, the laundry detergent adjunct ingredient is selected from the group consisting of: additional fabric-softening compounds; additional surfactants; builders; alkalinity systems; fabric-integrity compounds; viscosity-controlling systems; bleach; brighteners; enzymes; soil release polymers; dispersants; dye transfer inhibitors; perfumes; corrosion inhibitors; suds suppressers; lime soap; solvents; dyes; process aids; and combinations thereof.

The composition may comprise additional fabric-softening compounds, these being in addition to the fabric-softening silicone. Preferred additional fabric-softening compounds include fabric-softening clays. Additional fabric-softening compounds may also include fabric-softening quaternary ammonium compounds.

Preferably the composition may comprise fabric-softening clay. Typically, the composition comprises (by weight of the composition) from 1% to 20%, or from 1% to 15%, or even from 2% to 8% of a fabric-softening clay. Typically, the fabric-softening clay is selected from the group consisting of: allophane clays; chlorite clays, preferred chlorite clays are amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydoxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

Preferably, the fabric-softening clay is a smectite clay. Preferred smectite clays are beidellite clays, hectorite clays, laponite clays, montmorillonite clays, nontonite clays, saponite clays and mixtures thereof. Preferably, the smectite clay is a dioctahedral smectite clay. Preferred dioctahedral smectite clays are montmorillonite clays. The montmorillonite clay may be a low-charged montmorillonite clay (also known as sodium montmorillonite clay or Wyoming—type montmorillonite clay). The montmorillonite clay may be a high-charged montmorillonite clay (also known as calcium montmorillonite clay or Cheto—type montmorillonite clay).

The clay may be a light coloured crystalline clay mineral, preferably having a reflectance of at least 60, more preferably at least 70, or at least 80 at a wavelength of 460 nm. Preferred light coloured crystalline clay minerals are china clays, halloysite clays, dioctahedral clays such as kaolinite, trioctahedral clays such as antigorite and amesite, smectite and hormite clays such as bentonite (montmorillonite), beidilite, nontronite, hectorite, attapulgite, pimelite, mica, muscovite and vermiculite clays, as well as pyrophyllite/talc, willemseite and minnesotaite clays. Preferred light coloured crystalline clay minerals are described in GB2357523A and WO01/44425.

The fabric-softening clay, when present in the composition, is preferably in the form of a dispersion, typically having a volume average particle size of from 1 micrometer to 5,000 micrometers, preferably from 1 micrometer to 50 micrometers.

The clay, in combination with the silicone, gives a surprising fabric-softening performance, ease of ironing benefit, reduces creasing of fabric, confers an ease of ironing benefit to fabric, and improves the cleaning and whiteness-maintenance performance of the composition.

The composition may comprise one or more fabric-softening quaternary ammonium compounds, although the composition preferably comprises (by weight of the composition) less than 10% fabric-softening quaternary ammonium compound, more preferably less than 8%, or even less than 6% fabric-softening quaternary ammonium compound. Most preferably, the composition comprises no deliberately added fabric-softening quaternary ammonium compound.

Typical fabric-softening quaternary ammonium compounds are mono-alkyl quaternary ammonium surfactants. Suitable fabric-softening quaternary ammonium compounds comprise up to 26 carbon atoms. The fabric-softening quaternary ammonium compound can be a mono $C_{11}$–$C_{18}$ N-alkyl or alkenyl ammonium compound, wherein, the remaining N positions are substituted by methyl, hydroxyethyl or hydroxypropyl groups.

The fabric-softening quaternary ammonium compound can be a cationic mono-alkoxylated and bis-alkoxylated quaternary amine compound with a $C_6$–$C_{18}$ N-alkyl chain. Typically, the fabric-softening quaternary ammonium compound has the general formula:

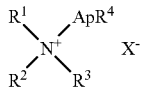

wherein, $R^1$ is an alkyl or alkenyl moiety comprising from 6 to 18 carbon atoms, preferably from 6 to 14 carbon atoms; $R^2$ and $R^3$ are each independently alkyl groups comprising from one to three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulphate, sulphate, or the like, to provide electrical neutrality; A is an alkoxy group, especially an ethoxy, propoxy or butoxy group; and p is a number from 0 to 30, preferably from 2 to 8. The substituent groups $R^1$, $R^2$, $R^3$ and A are independently either directly attached to the quaternary nitrogen atom or indirectly attached to the quaternary ammonium atom via an ester linkage, ether linkage or other such linkage.

The fabric-softening quaternary ammonium compounds can be a cationic bis-alkoxylated amine compound, typically having the general formula:

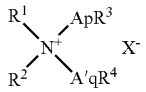

wherein, $R^1$ is an alkyl or alkenyl moiety comprising from 8 to 18 carbon atoms; $R^2$ is an alkyl group comprising from one to three carbon atoms, preferably methyl; $R^3$ and $R^4$ can vary independently and are selected from hydrogen (preferred), methyl and ethyl; $X^-$ is an anion such as chloride, bromide, methylsulphate, sulphate, or the like, sufficient to provide electrical neutrality; A and A' can vary independently and are each selected from $C_1$–$C_4$ alkoxy, especially ethoxy, (i.e., —$CH_2CH_2O$—), propoxy, butoxy and mixtures thereof; p is a number from 1 to 30, preferably from 1 to 4; and q is a number from 1 to 30, preferably from 1 to 4. Most preferably both p and q are 1. The substituent groups $R^1$, $R^2$, A and A' are independently either directly attached to the quaternary nitrogen atom or indirectly attached to the quaternary ammonium atom via an ester linkage, ether linkage or other such linkage.

Preferred fabric-softening quaternary ammonium compounds are di-long chain, di-short chain alkyl quaternary ammonium compounds, preferred are those wherein one or more, preferably at least two alkyl substituent chains are attached to the quaternary nitrogen atom via ester linkages. Most preferred are those wherein both of the long chain alkyl substituent groups are attached to the quaternary nitrogen atom via ester linkages. Preferred fabric-softening quaternary ammonium compounds are dialkyldimethylammonium salts having the formula:

$$R'R''N^+(CH_3)_2X^-$$

Wherein, each R' and R" is independently selected from the group consisting of $C_{12-30}$ groups, typically derived from tallow, coconut oil or soy, and X is $Cl^-$ or $Br^-$. Preferred are didodecyldimethylammonium bromide, dihexadecyldimethyl ammonium chloride, dihexadecyldimethyl ammonium bromide, dioctadecyldimethyl ammonium chloride, dieicosyldimethyl ammonium chloride, didocosyldimethyl ammonium chloride, dicoconutdimethyl ammonium chloride, ditallowdimethyl ammonium bromide. Other preferred quaternary ammonium compounds are described in U.S. Pat. No. 6,013,683.

Another suitable group of fabric-softening quaternary ammonium compounds that can be used are cationic ester compounds. Suitable cationic ester compounds, including choline ester compounds, are described in U.S. Pat. No. 4,228,042, U.S. Pat. No. 4,239,660 and U.S. Pat. No. 4,260,529.

A highly preferred fabric-softening quaternary ammonium compound has the general formula:

$$R_1R_2R_3R_4N^+X^-$$

wherein, $R_1$ has the general formula:

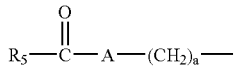

wherein, $R_2$ and $R_3$ are independently selected from the group consisting of $R_1$, $C_1$–$C_3$ alkyl and $C_1$–$C_3$ hydroxyalkyl; $R_4$ is selected from the group consisting of $C_1$–$C_3$ alkyl, $C_1$–$C_3$ hydroxyalkyl and hydrogen; $R_5$ is a $C_{8-22}$ alkyl or alkenyl group; $R_6$ is $C_1$–$C_3$ alkyl; a is a number from 1 to 3; A is O, NH or $NR_6$; $X^-$ is an anion, typically selected from the group consisting of chloride, bromide, methanoate, ethanoate, sulphate, sulphonate, phosphate, phosphonate and combinations thereof.

Particularly preferred is when $R_5$ is an alkyl group derived from canola oil; A is O; a is 2; $R_2$ is $R_1$; $R_3$ is 2-(hydroxyethyl); $R_4$ is methyl; and X is methylsulfate.

The composition may comprise additional surfactants. Typically, the additional surfactants are the non-alkoxylated non-ionic surfactants, non-alkoxylated cationic surfactants, non-alkoxylated zwitterionic surfactants, non-alkoxylated amphoteric surfactants, and combinations thereof. Suitable non-alkoxylated cationic surfactants may also act as a fabric-softening compound, and may be one of the fabric-softening quaternary ammonium compounds described above.

Suitable additional surfactants are semi-polar non-ionic surfactants, such as amine oxide surfactants having the general formula:

$$R_1(R_2)_2NO,$$

wherein, $R_1$ is an alkyl or alkylphenyl group comprising from 8 to 22 carbon atoms, $R_2$ is an alkyl or hyroxyalkyl group comprising from 1 to 3 carbon atoms. Particularly preferred is the $C_{10-18}$ alkyl dimethyl amine oxide.

Other suitable additional surfactants are the alkylpolysaccharides, such as those described in U.S. Pat. No. 4,565,647. Typically, these alkylpolysaccharides comprise a hydrophobic group comprising from 6 to 30 carbon atoms, and a polysaccharide, such as a polyglycoside hydrophilic group comprising from 1 to 10 saccharide units. Any reducing saccharide comprising 5 or 6 carbon atoms can be used, e.g. glucose, galactose and galactosyl moieties can be substituted for the glucosyl moieties. (Optionally, the hydrophobic group is attached at the 2-, 3-, 4-, etc. positions, thus giving a glucose or galactose as opposed to a glucoside or galactoside). The intersaccharide bonds can be between the one position of the additional saccharide units and the 2-, 3-, 4-, and/or 6-positions on the preceding saccharide units.

Other suitable additional surfactants are fatty acid amide surfactants having the general formula:

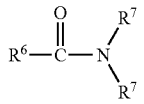

wherein, $R^6$ is an alkyl group comprising from 7 to 21 carbon atoms, and each $R^7$ is independently selected from the group consisting of hydrogen, $C_1$–$C_4$ alkyl, and $C_1$–$C_4$ hydroxyalkyl. Preferred fatty acid amides are $C_8$–$C_{20}$ ammonia amides, monoethanolamides, diethanolamides, and isopropanolamides. The $C_{10}$–$C_{18}$ N-alkyl polyhydroxy fatty acid amides can also be used. Typical examples include the $C_{12}$–$C_{18}$ N-methylglucamides, Other suitable additional surfactants are sugar-derived surfactants, including the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing.

Preferably, the composition comprises a builder. Typically, the builder is a water-soluble builder compound, typically present in composition at a level of from 1% to 60% by weight of the composition, preferably from 3% to 40% by weight, most preferably from 5% to 25% by weight of the composition.

Suitable water-soluble builder compounds include the water-soluble monomeric carboxylates, or acids thereof, polycarboxylates or acids thereof, homo- or co-polymeric polycarboxylic acids or salts thereof in which the polycarboxylic acid comprises at least two carboxylic radicals separated from each other by no more that two carbon atoms, borates, and mixtures of any of the foregoing. The carboxylate or polycarboxylate builder can be monomeric or oligomeric in type although monomeric polycarboxylates are generally preferred for reasons of cost and performance.

A preferred builder is citric acid and/or citrate. These builders may be present in addition to the fatty acids described above, which can also act as detergent builders. Highly preferred are citric acid and/or sodium citrate builders, preferably present at a level of 1% to 20%, more preferably from 3% to 15%, more preferably from 5% to 12% by weight of the composition.

Borate and boric acid builders, as well as builders containing borate-forming materials that can produce borate under detergent storage or wash conditions are useful water-soluble builders.

The detergent compositions of the invention may comprise phosphate-containing builders, typically water-soluble phosphate-containing builders, preferably present at a level of from 2% to 40%, more preferably from 3% to 30%, more preferably from 5% to 20% by weight of the composition. Suitable examples of water-soluble phosphate-containing builders are the alkali metal tripolyphosphates, sodium, potassium and ammonium pyrophosphate, sodium and potassium and ammonium pyrophosphate, sodium and potassium orthophosphate, sodium polymeta/phosphate in which the average degree of polymerization is in the range of from 6 to 21, and salts of phytic acid.

The composition may optionally comprise bleach. Typically, the bleach is present at a level of from 1% to 30% by weight of the composition. The bleach typically comprises a source of hydrogen peroxide and a bleach activator. The bleach may also comprise a bleach catalyst or a bleach booster. If present, the bleach activator is typically present at a level of from 0.5% to 40% by weight of the bleach.

Typically, the bleach is a perborate bleach: and comprises sodium perborate (mono- or tetra-hydrate). Alternatively, the bleach can be a percarbonate bleach, or a mixture of percarbonate and perborate. The bleach may comprise percarboxylic acid bleaching agents and/or salts thereof. Suitable bleaching agents are described in U.S. Pat. No. 4,483,781 and EP133354. In addition, suitable organic peroxides, especially diacyl peroxides are described in Kirk Othmer, Encyclopedia of Chemical Technology, Vol. 17, John Wiley and Sons, 1982 at pages 27–90 and especially at pages 63–72. Suitable organic peroxides, especially diacyl peroxides, are further illustrated in "Initiators for Polymer Production", Akzo Chemicals Inc., Product Catalog, Bulletin No. 88–57.

Typically, the peroxygen bleaching agent, e.g. the perborate and/or percarbonate, is preferably combined with a bleach activator, which during the washing process leads to the in-situ formation of a corresponding peroxy acid. Suitable bleach activators are described in U.S. Pat. No. 4,634,551, U.S. Pat. No. 4,915,854 and U.S. Pat. No. 4,412,934. The nonanoyloxybenzene sulfonate (NOBS) and tetraacetyl ethylene diamine (TAED) bleach activators and mixtures thereof are typically preferred. Preferred bleach activators include (6-octanamidocaproyl)oxybenzene-sulfonate, (6-nonanamidocaproyl)oxybenzenesulfonate, (6-decanamidocaproyl)oxybenzene-sulfonate, and mixtures thereof.

Another class of bleach activators that can be used is the benzoxazin-type bleach activators. These are described in U.S. Pat. No. 4,966,723. Another class of bleach activators that can be used is the acyl lactam bleach activators, especially acyl caprolactams and acyl valerolactams. Highly preferred lactam bleach activators are selected from the group consisting of benzoyl caprolactam, octanoyl caprolactam, 3,5,5-trimethylhexanoyl caprolactam, nonanoyl caprolactam, 4-nitrobenzoyl caprolactam, and mixtures thereof.

If desired, the bleach can comprise a bleach catalyst, for example, a manganese-based bleach catalyst. Suitable bleach catalysts are described in U.S. Pat. No. 5,246,621, U.S. Pat. No. 5,244,594, U.S. Pat. No. 5,194,416, U.S. Pat. No. 5,114,606, EP549271, EP549272, EP544440 and EP544490. The bleach may also comprise a quaternary substituted bleach activator, such as those described in U.S. Pat. No. 4,539,130, GB1382594, U.S. Pat. No. 4,818,426, U.S. Pat. No. 5,093,022, U.S. Pat. No. 4,904,406, EP552812 and EP540090. Non-oxygen bleaches can also be used. One type of non-oxygen bleach that can be used is a photoactivated bleach, such as a sulphonated zinc and/or aluminum phthalocyanine.

The composition preferably comprises a chelant. Chelants act to sequester (i.e. chelate) heavy metal ions. These components may also have calcium and magnesium chelation capacity, but preferentially they show selectivity to binding heavy metal ions such as iron, manganese and copper. Chelants are generally present at a level of from 0.005% to 10%, preferably from 0.1% to 5%, more preferably from 0.25% to 7.5% and most preferably from 0.3% to 2% by weight of the compositions. Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxyethylene 1,1 diphosphonate, 1,1 hydroxyethane diphosphonic acid and 1,1 hydroxyethane dimethylene phosphonic acid.

The composition may optionally comprise (by weight of the composition) from 0.005% to 5% optical brightener. Preferred optical brighteners include 4,4',-bis[(4-anilino-6-(N-2-bis-hydroxyethyl)-s-triazine-2-yl)amino]-2,2'-stilbenedisulfonic acid and disodium salt, commercially marketed under the tradename Tinopal-UNPA-GX by Ciba-Geigy Corporation; 4,4'-bis[(4-anilino-6-(N-2-hydroxyethyl-N-methylamino)-s-triazine-2-yl)amino]2,2'-stilbenedisulfonic acid disodium salt, commercially marketed under the tradename Tinopal 5BM-GX by Ciba-Geigy Corporation; 4,4'-bis[(4-anilino-6-morphilino-s-triazine-2-yl)amino]2,2'-stilbenedisulfonic acid, sodium salt, commercially marketed under the tradename Tinopal-DMS-X and Tinopal AMS-GX by Ciba Geigy Corporation.

The composition may comprise one or more enzymes. Preferred enzymes include lipases, cutinases, amylases, neutral and alkaline proteases, cellulases, endolases, esterases, pectinases, lactases, peroxidases, and combinations thereof.

The composition may comprise dispersants. Typically, the dispersant is present at a level of from 0.1% to 7% by weight of the composition. Suitable dispersants are alkoxylated polyethyleneimines, polymeric polycarboxylates and polyethylene glycols.

The composition may also comprise (by weight of the composition) from 0.01% to 10%, preferably from 0.05% to 0.5% by weight of a polymeric dye transfer inhibiting agent. The polymeric dye transfer inhibiting agent is preferably selected from polyamine N-oxide polymers, copolymers of N-vinylpyrrolidone and N-vinylimidazole, polyvinylpyrrolidonepolymers and combinations thereof. These polymers can be cross-linked polymers.

The composition may comprise a suds-suppressing system present at a level of from 0.01% to 15%, preferably from 0.02% to 10%, most preferably from 0.05% to 3% by weight of the composition. This is especially preferred when the composition is formulated for use in an automatic washing machine. Suitable suds-suppressing systems for use herein may comprise any known antifoam compound, including for example silicone antifoam compounds and 2-alkyl alcanol antifoam compounds. The silicone antifoam compounds are present in addition to the fabric-softening silicone, which is described in more detail above.

The composition typically comprises water and/or other solvents such as low molecular weight primary or secondary alcohols, preferably methanol, ethanol, propanol, isopropanol, and mixtures thereof. Monohydric alcohols are preferred for solubilizing surfactant, but polyols such as those containing from 2 to about 6 carbon atoms and from 2 to about 6 hydroxy groups (e.g. 1,3-propanediol, ethylene glycol, glycerine, and 1,2-propanediol) may also be used. The composition typically comprises from 5% to 90% by weight of the composition, water and/or other solvents.

The composition will preferably be formulated such that, during use in aqueous cleaning operations, the wash liquor will have a pH of between 6.5 and 10, preferably between 7.5 and 9. Techniques for controlling pH at recommended usage levels include the use of buffers, alkalis, acids, etc.

Liquid Softening Through the Wash Laundry Detergent Composition

The composition is capable of cleaning and softening fabric during a washing process. Typically, the composition is formulated for use in an automatic washing machine, although it can also be formulated for hand-washing use. The composition may also be in a unit dose form, typically being in the form of a pouch and enclosed by a water-soluble film such as polyvinyl alcohol. The composition may be at least partially enclosed, preferably completely enclosed, by a water-soluble material, preferably a polyvinylalcohol film. The composition typically has a viscosity of from 500 cps to 3,000 cps, when measured at a shear rate of 20 $s^{-1}$ at ambient conditions. The composition typically has a density of from 800 g/l to 1300 g/l.

Typically, the composition is typically in the form of a dispersion, usually having a volume average particle size of from 1 micrometer to 5,000 micrometers, preferably from 1 micrometer to 50 micrometers. The particles that form the dispersion, are usually the fabric-softening silicone, and, if present, the fabric-softening clay.

Typically, a Coulter Multisizer is used to measure the volume average particle size. Typically, the following method is used 0.25 g of the material to be analyzed is added to 199.75 g demin water in a 250 ml beaker to form a mixture. The mixture is mixed for 1 minute with a magnetic stirrer. For example with a Heidolph MR 3001K magnetic stirrer at a stirring speed of 750 rpm and with a stirring bar that is 40 mm long and 8 mm wide. The beaker is than transferred to the sample stand of the Coulter Multisizer, the stirring speed is set to position 1.5 of the sample stand and the mano-selector of the Coulter Multisizer is set at 2,000 μl. Measuring time is set at 25 seconds and the maximum aperture of the measuring tube is 140 micrometers. The volume average particle size of the mixture is measured twice, and the results of the two measurements are looked at the volume differential results, and the volume average particle size of the mixture is determined.

EXAMPLES

Example 1

A liquid softening through the wash laundry detergent composition that is in accordance with the present invention is prepared by the following method: 80 g non-alkoxylated $C_{12-15}$ linear alkylbenzene sulfonate anionic surfactant, 10 g of $C_{13-15}$ alcohol nonionic surfactant having an average ethoxylation degree of from 5 to 9, 7.5 g sodium cumene sulphonate, 36.5 g of palm kernel fatty acid, 20.5 g of rapeseed fatty acid, 12.5 g citric acid, 6 g of boric acid and 7.5 g of 1-hydroxy ethane 1,1-diphosphonic acid are mixed with 237.75 g of water, 5 g ethanol and 40 g 1,2 propandiol at low speed (e.g. being stirred at less than 500 rpm) to form a mixture. The pH of the mixture is adjusted to 8.0 using a glass electrode with NaOH and/or monoethanolamine. 2.5 g of protease, 0.75 g of amylase, 2.5 g of perfume and 0.75 g of optical brightener are added to the mixture (which is still being stirred at low speed, e.g. less than 500 rpm). 17.5 g of montmorillonite clay is then added to the mixture at medium shear (e.g. being stirred at 700 rpm) and the mixture is then stirred for a further 10 minutes at medium shear (i.e. at 700 rpm). 15 g of polydimethylsiloxane (Dow Corning Silicone $DC_{200}$™, 100,000 cst) is added to the mixture using a syringe and the mixture is stirred at high speed (e.g. 1600 rpm) for a further 20 minutes. Finally, 0.75 g of pre-crystallised hydrogenated castor oil is added to the mixture using a syringe, and the mixture is stirred at high speed (e.g. 1800 rpm) for a further 30 seconds, to form a liquid softening through the wash laundry detergent composition.

Example 2

The following liquid softening through the wash laundry detergent compositions are in accordance with the present invention. The amounts given below are % by weight of the composition.

| Ingredient | A | B | C | D | E | F | G | H |
|---|---|---|---|---|---|---|---|---|
| Polydimethyl siloxane having an average particle size of from 5 μm to 10 μm | 3.0% | 2.0% | 5.0% | 4.0% | 3.0% | | | |
| Polydimethyl siloxane having an average particle size of from 1 μm to 4 μm | | | | | | 3.0% | 4.0% | 2.0% |
| Non-alkoxylated $C_{12-15}$ linear alkylbenzene sulfonate anionic surfactant | 16.0% | 18.0% | 16.0% | 14.0% | 15.0% | 16.0% | 17.0% | 16.0% |
| $C_{13-15}$ alcohol nonionic surfactant having an average ehtoxylation degree of from 5 to 9 | 2.0% | | 1.0% | 2.0% | 3.0% | 2.0% | | |
| Palm Kernel fatty acid | 7.3% | 12.0% | 7.8% | 7.3% | 6.0% | 9.0% | 7.5% | |
| Rapeseed fatty acid | 4.1% | 3.5% | 4.0% | 3.5% | 5.0% | 2.0% | 4.5% | 11.5% |
| Montmorillonite clay | 3.4% | 3.0% | 6.5% | | | | | |
| Hectorite clay | | | 0.5% | | | | | |
| $C_{8-10}$ amidopropyl dimethylamine | | | | | | | | 1.5% |
| Citric acid | 2.5% | 1.5% | 2.5% | 2.0% | 2.0% | 1.5% | 2.5% | 2.0% |
| Protease | 0.5% | 0.4% | 0.4% | 0.5% | 0.5% | 0.4% | 0.5% | |
| Amylase | 0.15% | 0.2% | 0.1% | 0.1% | 0.1% | 0.2% | | 0.2% |
| Optical brightener | 0.15% | 0.1% | 0.2% | 0.1% | 0.2% | 0.1% | 0.2% | 0.1% |
| Ethoxylated polyethyleneimine | | | | | | | | 2.0 |
| 1-hydroxy ethane 1,1-diphosphonic acid | 1.5% | 1.0% | 1.0% | 2.0% | 1.5% | 1.5% | 2.0% | 1.0% |
| N,N-di(canoloyloxyethyl)N-(hydroxyethyl)N-methyl ammonium methylsulfate | | | | 4.0% | | | | |
| Hydrogenated castor oil | 0.15% | 0.15% | 0.15% | 0.1% | 0.1% | 0.2% | 0.15% | 0.1% |
| Boric Acid | 1.2% | 1.2% | 1.2% | 1.5% | 1.3% | 1.5% | 1.0% | 1.0% |
| Ethanol | 1.0% | 1.0% | 1.0% | 3.0% | 4.0% | 1.0% | 1.0% | 0.9% |
| 1,2-Propanediol | 8.0% | 8.0% | 7.0% | 9.0% | 6.0% | 8.0% | 5.0% | 8.0% |
| Sodium cumene sulphonate | 1.5% | 2.0% | 1.5% | 1.5% | 2.0% | 1.5% | 2.5% | 1.5% |
| Monoethanolamine | | | | | | | to pH 8.0 | |
| Sodium hydroxide | to pH 8.0 | to pH 8.0 | to pH 8.0 | to pH 8.0 | to pH 8.0 | to pH 8.0 | | to pH 8.0 |
| Miscellaneous and water | to 100% | to 100% | to 100% | to 100% | to 100% | to 100% | to 100% | to 100% |

The invention claimed is:

1. A liquid softening through the wash laundry detergent composition comprising:

(a) at least 0.5% by weight of the composition, of a fabric softening silicone;

(b) a fatty acid;

(c) a surfactant system, the surfactant system comprising:

(i) at least 75% by weight of the surfactant system, of a non-alkoxylated anionic surfactant; and (ii) less than 25% by weight of the surfactant system, of an alkoxylated surfactant;

(d) a fabric-softening clay; and (e) one or more laundry detergent adjunct ingredients, wherein the detergent composition is free of fabric-softening quaternary ammonium compounds.

2. A composition according to claim 1, wherein the surfactant system comprises less than 15% by weight of the surfactant system, of an alkoxylated surfactant.

3. A composition according to claim 1, wherein the composition comprises more than 0.8% by weight of the composition, of a fabric softening silicone.

4. A composition according to claim 1, wherein the ratio of the combined weight of the non-alkoxylated anionic surfactant and the fatty acid to the weight of the alkoxylated surfactant is greater than 3:1 or greater.

5. A composition according to claim 4, wherein the ratio of the combined weight of the non-alkoxylated anionic surfactant and the fatty acid to the weight of the alkoxylated surfactant is from 10:1 to 20:1.

6. A composition according to claim 1, wherein the fabric-softening silicone is in the form of an emulsion having a primary particle size of from 1 micrometer to less than 50 micrometers.

7. A composition according to claim 6, wherein the emulsion has a primary particle size of from 1 micrometer to less than 5 micrometers.

8. A composition according to claim 1, wherein the composition comprises less than 2% by weight of the composition, of an alkoxylated surfactant.

9. A composition according to claim 1, wherein the weight ratio of non-alkoxylated anionic surfactant to alkoxylated surfactant is from 7:1 to 15:1.

10. A composition according to claim 1, wherein the fabric-softening silicone is a polydimethyl siloxane.

11. A composition according to claim 1, wherein the composition comprises from 10% to 50% by weight of the composition, of a surfactant system.

12. A composition according to claim 1, wherein the non-alkoxylated anionic surfactant is an alkyl sulphate surfactant and/or an alkylbenzene sulphonate surfactant.

13. A composition according to claim 1, wherein the alkoxylated surfactant is an alkoxylated non-ionic surfactant.

14. A composition according to claim 13, wherein the alkoxylated non-ionic surfactant is an ethoxylated $C_{12\sim15}$ alcohol having an average degree of ethoxylation of from 5 to 9.

15. A composition according to claim 1, wherein the composition comprises from 5% to 20% by weight of the composition, of fatty acid.

16. A composition according to claim 1, wherein the fatty acid is a $C_{12-18}$ substituted or unsubstituted fatty acid.

17. A composition according to claim 1, wherein the composition comprises from 2% to 8% by weight of the composition of the fabric-softening clay.

18. A composition according claim 1, wherein the fabric-softening clay is a montmorillonite clay.

19. A composition according to claim 1, wherein the composition is at least partially enclosed by a water-soluble material.

20. A composition according to claim 1, wherein the composition comprises from 1% to 20% by weight of the composition, of the fabric-softening clay.

21. A composition according to claim 1, wherein the composition comprises from 1% to 15% by weight of the composition, of the fabric-softening clay.

22. A method for enhancing the deposition of a silicone onto fabric during a laundering process, the method comprising laundering the fabric with a composition according to claim 1.

* * * * *